US005701144A

United States Patent [19]

Tang

[11] Patent Number: 5,701,144

[45] Date of Patent: Dec. 23, 1997

[54] HIGH-SPEED IMAGE REGISTER FOR GRAPHICS DISPLAY

[75] Inventor: Alex Tang, Hsin-Chu, Taiwan

[73] Assignee: United Microelectronics Corporation, Taiwan

[21] Appl. No.: 430,016

[22] Filed: Apr. 27, 1995

[51] Int. Cl.[6] ..... G09G 5/36

[52] U.S. Cl. ..... 345/188; 345/190; 345/200; 345/201

[58] Field of Search ..... 345/188, 189, 345/190, 193, 200, 201, 202, 203, 113; 395/163, 166

[56] References Cited

U.S. PATENT DOCUMENTS

| | | | |
|---|---|---|---|
| 4,317,114 | 2/1982 | Walker | 345/113 |
| 4,910,683 | 3/1990 | Bishop et al. | 345/201 |
| 4,924,432 | 5/1990 | Asai et al. | 395/166 |
| 5,036,475 | 7/1991 | Ueda | 345/189 |
| 5,530,798 | 6/1996 | Chu et al. | 395/163 |

*Primary Examiner*—Richard Hjerpe
*Assistant Examiner*—Ricardo Osorio
*Attorney, Agent, or Firm*—Barnes, Kisselle, Raisch, Choate, Whittemore & Hulbert, P.C.

[57] ABSTRACT

An image register for a graphics display includes a pair of static random access memory (SRAM) devices for respectively storing image data associated with even numbered and odd numbered pixels, which correspond to even numbered and odd numbered addresses. The register includes a counter presettable to an initial value corresponding to a starting address of the stored image data. When the counter outputs an even address (an even state), the even SRAM is enabled for a write operation if an input layer code has a higher priority than the priority of the layer code for the image data stored in the even SRAM, although the odd SRAM is always enabled for a read operation in the even state. The read and write operations occur simultaneously. During the read operation on the odd SRAM, the layer code portion of the image data retrieved therefrom is latched in an associated buffer, whose output is fed to an associated comparator. When the counter is incremented during the next clock cycle, the counter outputs an odd address (an odd state), wherein the odd SRAM is enabled for a write operation if an input layer code has a higher priority than the priority of the retrieved layer code buffered from the prior cycle, although the even SRAM is always enabled for a read operation in the odd state. Both operations occur simultaneously. In both the even and odd states, if the priority of the input layer code is not higher than the priority of the layer code associated with the current image data, the original image data is retained in the even and odd SEAMs, respectively.

10 Claims, 3 Drawing Sheets

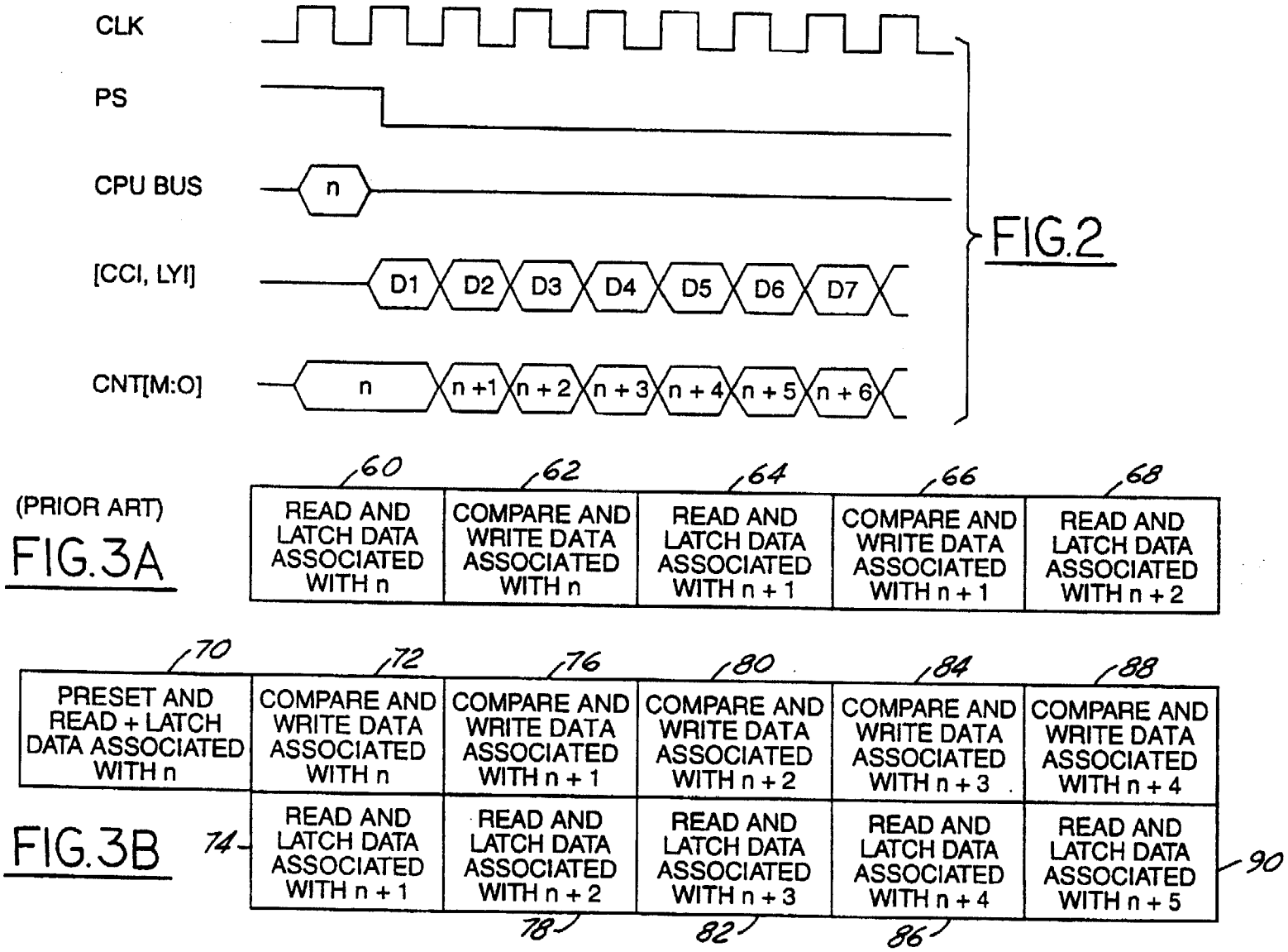
CLK
PS
CPU BUS
[CCI, LYI]
CNT[M:O]
n
D1
D2
D3
D4
D5
D6
D7
n
n+1
n+2
n+3
n+4
n+5
n+6
FIG.2
(PRIOR ART)
FIG.3A
60
READ AND LATCH DATA ASSOCIATED WITH n
62
COMPARE AND WRITE DATA ASSOCIATED WITH n
64
READ AND LATCH DATA ASSOCIATED WITH n+1
66
COMPARE AND WRITE DATA ASSOCIATED WITH n+1
68
READ AND LATCH DATA ASSOCIATED WITH n+2
70
PRESET AND READ+LATCH DATA ASSOCIATED WITH n
72
COMPARE AND WRITE DATA ASSOCIATED WITH n
74
READ AND LATCH DATA ASSOCIATED WITH n+1
76
COMPARE AND WRITE DATA ASSOCIATED WITH n+1
78
READ AND LATCH DATA ASSOCIATED WITH n+2
80
COMPARE AND WRITE DATA ASSOCIATED WITH n+2
82
READ AND LATCH DATA ASSOCIATED WITH n+3
84
COMPARE AND WRITE DATA ASSOCIATED WITH n+3
86
READ AND LATCH DATA ASSOCIATED WITH n+4
88
COMPARE AND WRITE DATA ASSOCIATED WITH n+4
90
READ AND LATCH DATA ASSOCIATED WITH n+5
FIG.3B

HIGH-SPEED IMAGE REGISTER FOR GRAPHICS DISPLAY

FIELD OF THE INVENTION

The present invention relates generally to an image register for image processing, and more particularly, relates to a high-speed image register for image processing in a graphics display that does not require a wait state.

BACKGROUND OF THE INVENTION

In a conventional graphics display, an image register is often provided for the processing of information associated with the displayed image, particularly information associated with each pixel of the image. In particular, a layer code may be associated with each pixel (i.e., a graphics image may have multiple layers). Further, each layer of the graphics image may be assigned a relative priority. Thus, when renewing an image on a graphics display, a system for controlling the displayed image must ensure that the data stored in a memory associated with the image register is modified only in accordance with the layer code priority encoded in the layer code.

This modification process customarily requires two steps: a first step is to read the image data, including the associated layer code, from the image register memory, and a second step is to compare, using the image register circuitry, the layer code of the retrieved image data to the layer code of the incoming image data proposed for storage in the image memory. In such a conventional arrangement, if the layer priority of the incoming image data is higher than the layer priority of the image data retrieved from the image register memory, then the incoming image data, including the layer code, are stored in the image memory; otherwise, the retrieved image data is retained in the image memory.

As can be appreciated, the conventional graphics arrangement requires a complicated two-step process for each image pixel, including a "wait" step required for retrieving the stored image data prior to comparison (i.e., processing). This essentially serial processing, on a per pixel basis, employed in conventional image registers limits the speed of image renewal to a graphics display.

It is therefore an object of the present invention to provide an image register used in a graphics display system that reduces or minimizes the shortcomings of the prior art image register devices.

It is another object of the present invention to provide an image register for a graphics display system that can process image data at higher speeds relative to conventional methods.

It is a further object of the present invention to provide an image register for a graphics display system that can process data at a high rate of speed without requiring a wait state.

It is another object of the present invention to provide an image register for a graphics display system that can simultaneously read and write image data by way of a parallel architecture such that the speed of image processing is greatly increased.

SUMMARY OF THE INVENTION

This invention generally provides an image register for processing input image data associated with a range of addresses including even and odd addresses wherein the input image data includes a layer code portion indicative of a priority level. The image register in accordance with this invention includes a first memory means for storing the image data associated with the even addresses, a second memory means for storing the image data associated with the odd addresses, an address means for addressing the first and second memory means in accordance with an even state and an odd state, and a processing means coupled to the first and second memory means. The even state exists when the image register is processing (i.e., comparing and writing the result into memory) image data associated with even addresses; the odd state exists when the register is processing image data associated with odd addresses.

The processing means is provided for simultaneously, during the even state, reading stored image data from the second memory means and selectively writing the input image data into the first memory means according to a priority associated with the layer code portion of the input image data. The processing means also performs the function of simultaneously, during the odd state, reading stored image data from the first memory means and selectively writing the input image data into the second memory means according to the priority of the input layer code.

The above mentioned reading/writing operations to associated first and second memory means relate to consecutive pixels, which are associated with consecutive addresses (i.e., either an even—odd, or an odd—even sequence). The inventive image register thus operates on the image data stored in the two memory means in parallel to thereby improve the processing speed by eliminating the so-called "wait" state required by conventional image registers, since during any cycle, the required layer code has already been retrieved and buffered during the prior cycle and is immediately available for processing.

In a preferred embodiment, the first and second memory means each comprise a static random access memory (SRAM) device for storing image data, including a layer code. The address means comprises a counter having a presettable initial value for producing an address for the second (odd) SRAM. The address means further comprises an adder coupled to the counter output for calculating an address of the first (even) SRAM.

The processing means of the preferred embodiment comprises first and second D-type flip-flops used as buffers connected to the even and odd SRAMs for temporarily storing the respective even and odd SRAM outputs. The processing means further includes first and second comparators connected, respectively, to the first and second flip-flops for comparing the layer code latched in the respective flip-flops to the layer code associated with the input image data. The respective outputs of the comparators are gated by a pair of NAND gates, whose respective output is coupled to the SRAMs for controlling whether a read or a write operation is performed. It should be appreciated that the benefit of the image register in accordance with the present invention is realized by the use of two SRAM devices such that even number and odd number pixels of the image display, which are stored in corresponding even and odd addresses, respectively, can be operated on separately (i.e., in parallel) to eliminate the prior art "wait" state to improve the speed of processing, as compared to the sequential processing employed by conventional image registers.

These and other features and objects of this invention will become apparent to one skilled in the art from the following detailed description and the accompanying drawings illustrating features of this invention by way of example.

BRIEF DESCRIPTION OF THE DRAWINGS

FIG. 2 is a partial timing sequence chart for the image register embodiment of FIG. 1 showing various input signals.

FIG. 3A is a simplified function sequence chart depicting the relative processing progress of a prior art image register for processing data.

FIG. 3B is a simplified function sequence chart of the image register embodiment of FIG. 1 showing the accelerated progress, relative to prior art image registers, in processing image data.

DETAILED DESCRIPTION OF THE PREFERRED EMBODIMENT

Figure 1:
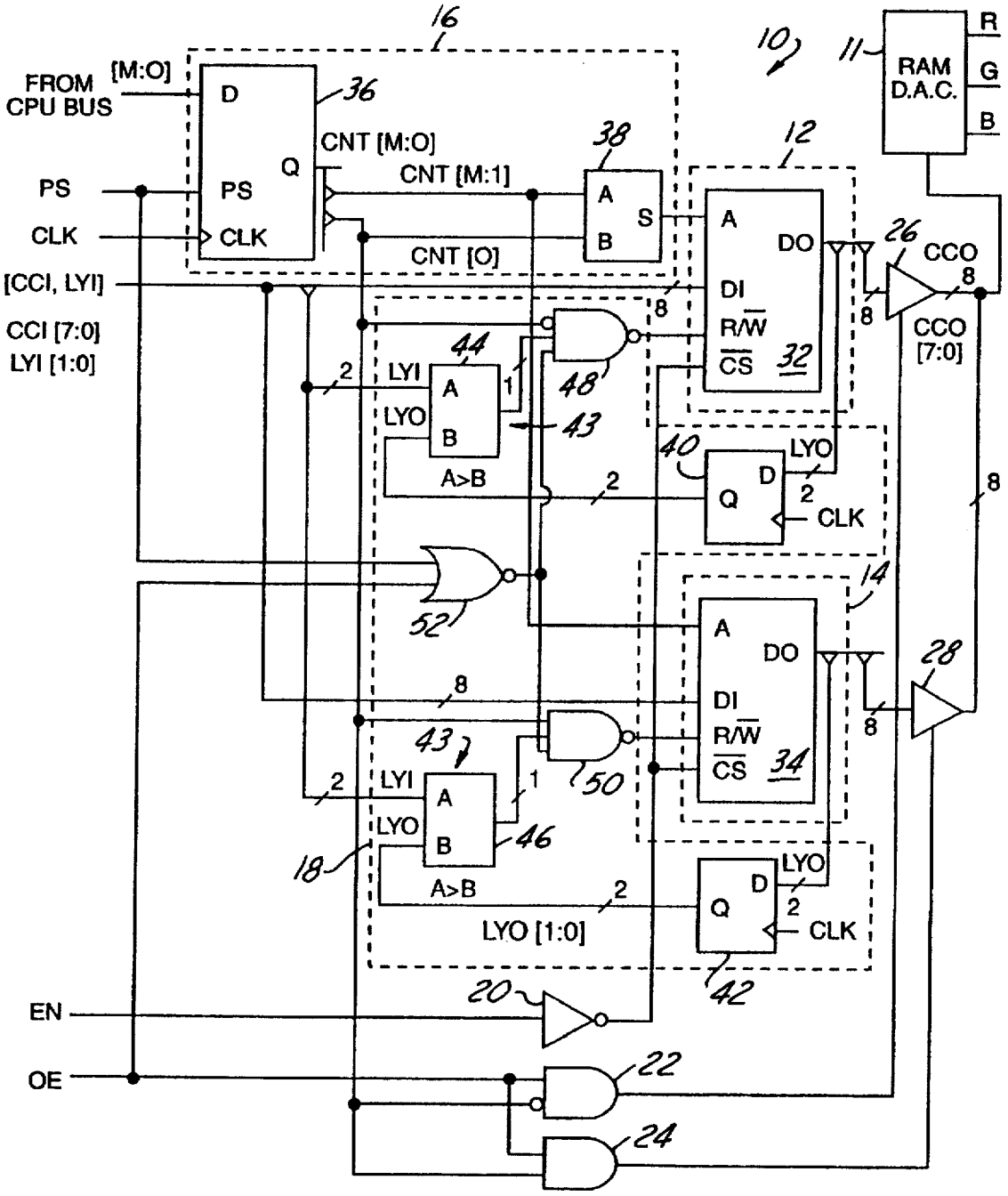
FIG. 1 is a partial circuit diagram view of an image register embodiment of the present invention utilizing two SRAM devices to implement a parallel processing architecture.

FIG. 1 shows a buffer circuit or image register 10 for use in a graphics display system for processing image data, although it should be appreciated that the described embodiment may be adapted for use in other environments and still remain within the spirit and scope of the present invention. Before proceeding to a detailed description of image register 10 referred to the drawings, a description of the overall functioning of register 10 will be set forth.

Referring to FIG. 1, image register 10 is adapted for receiving image data as an input (as a stream of image data—pixel data) wherein each pixel data point/segment includes a color code input (CCI), and an associated layer code input (LYI). Image register 10 processes these incoming pixels and provides a corresponding color code output (CCO) for each processed pixel. Preferably, both the color code input CCI and color code output CCO are 8-bit quantities [7:0]; the layer code input LYI and the layer code output LYO are two-bit quantities [1:0]. As shown in FIG. 1 the output CCO may be, for example, sent to a Random Access Memory (RAM) Digital-to-Analog Converter (DAC) 11 to provide a respective Red (R), Green (G), and Blue (B) analog output to a video display (not shown). DAC 11 is a commercially available component, and may be, for example, a UM70C188 available from United Microelectronics Corp., assignee of the present invention. The layer code associated with the pixel being processed is used to define the depth of the image. For example, in a binary (i.e., two-bit length) layer code, LYI may take on the following meaning:

0: transparent layer,

1: the deepest layer,

2: the middle layer,

3: the shallowest layer.

The foregoing layer definitions define a priority schedule. Image register 10 operates in accordance with this priority schedule as follows. When the layer priority associated with an incoming pixel is higher than a priority of a corresponding pixel stored in image register 10, the image data associated with the incoming pixel, [CCI, LYI], is written into the image register memory; otherwise, the pre-existing image data associated with that pixel is retained in the image register memory for later output [COO]. For example, when the layer code of the incoming image data that will be written in the image register memory is a "1" (a deep layer), the image register 10 abandons the conditional write operation into the image register memory, and instead, retains or replaces the image data in the image register memory with the image data originally in the image register memory.

As mentioned above, separate input image data is provided as an input to image register 10, in the form of pixel data, for each address in a range of addresses to which the image data is associated, including even addresses and odd addresses, which correspond to even numbered and odd numbered pixels. This range of addresses is related to and corresponds to screen coordinates of a graphics display.

Image register 10 includes first memory means 12 for storing input image data associated with even addresses (i.e., even numbered pixels), second memory means 14 for storing input image data associated with odd addresses (i.e., odd numbered pixels), an address means 16 for addressing first and second memory means 12 and 14 according to an even state and an odd state, and a processing means 18 coupled to memory means 12 and 14. The even state exists when the image register is processing (i.e., comparing and writing the result into memory) image data associated with even addresses; the odd state exists when the register is processing image data associated with odd addresses.

Processing means 18 is provided for performing the function of, during the even state, simultaneously reading stored image data from second memory means 14 and selectively writing the input image data [CCI, LYI] into first memory means 12 according to the priority associated with the layer code portion of the input image data [LYI]. Processing means 18 is further provided for performing the function of, during the odd state, of simultaneously reading stored image data from first memory means 12 and selectively writing the input image data [CCI, LYI] into second memory means 14 according to the priority associated with the layer code portion of the input image data [LYI]. The above mentioned reading/writing operations to associated first and second memory means 12 and 14 relate to consecutive pixels (i.e., an even/odd, or an odd/even sequence) associated with consecutive addresses. The reading operation relates to image data associated with an address in advance (i.e., n+1) of the address associated with the image data being processed (i.e., n). It should be appreciated that the input image data [CCI, LYI] associated with even and odd numbered pixels (i.e., even and odd numbered addresses, respectively) are therefore operated on in parallel to thereby improve processing speed.

Image register 10 further includes an inverter gate 20 coupled to a positive logic enable signal EN. The enable signal EN, when present, activates first and second memory means 12, 14 for read and write operations.

Image register 10 may further include a pair of two-input AND gates 22, 24 having one of their respective inputs connected to a positive logic output enable signal OE. When the output enable signal OE is high, one of the first and second output multiplexers 26, 28 is selected, based on an even/odd select signal CNT [0] generated by address means 16, to pass image data from first and second memory means 12, 14 to the output COO of image register 10.

First memory means 12 preferably takes the form of a static random access memory (SRAM) 32 which includes a control input, R/$\overline{W}$, for controlling storage of the image data into SRAM 32, as well as controlling retrieval of the addressed image data stored therein. SRAM 32 is a commercially available component, such as, for example, a UM 611024, available from United Microelectronics Corp., assignee of the present invention. SRAM 32 further includes an address input A, coupled to an output generated by address means 16, for selecting an address within SRAM 32, a data input DI [7:0], coupled to the input image data [CCI, LYI], a negative-logic chip select input, $\overline{CS}$, coupled to an inverted version of the enable signal EN, and a data output, DO [7:0] coupled to multiplexer 26.

Second memory means 14 is also preferably an SRAM device 34, also having a control input, R/$\overline{W}$, for controlling storage of the input image data into SRAM 34, and for controlling retrieval of addressed image data stored therein. SRAM 34 is identical to SRAM 32. In an alternate embodiment of this invention, first and second memory means 12, 14 may comprise a latch-type memory device (not illustrated), or a D-type flip flop (DFF) type device (not illustrated).

As shown in FIG. 1, address means 16 includes an address generator 36, preferably a presettable counter, and a half adder 38. Counter 36 may be preset to an initial value, which is preferably determined by a system CPU and is provided as an input [M:0] to its D input on a CPU bus. The initial value for counter 36 corresponds to a starting address of the image data being written into/processed by image register 10. This initial value is set by asserting a preset control signal PS coupled to counter 36. Counter 36 has an output, CNT [M:0], which is incremented in accordance with an input clock signal CLK. The least significant bit (LSB) of counter 36 output, CNT [0], defines the even/odd select signal, which determines whether CNT [M:0] (i.e., the image address) is an even number or an odd number which, in turn, defines the even state and odd state of image register 10. Half adder 38 is provided for calculating the address for SRAM 32.

As shown in FIG. 1, processing means 18 includes a first buffer 40, preferably a D-type flip-flop (DFF), a second buffer 42, also preferably a DFF, a comparison means 43 comprising a first comparator 44 and a second comparator 46, a first control gate 48, preferably a NAND gate, a second control gate 50, also preferably a NAND gate, and a preset gate 52, preferably a NOR gate. As discussed above, SRAM 32 is provided for storage of image data associated with even numbered pixels (i.e., even addresses) while SEAM 34 is provided for storage of image data associated with odd numbered pixels (i.e., odd addresses). To provide parallel paths for both the even and odd pixels, SEAM 32 (even) has its data output DO connected to an input of DFF 40. In the preferred embodiment, only the layer code portion of the stored image data, LYO, is coupled to DFF 40. In a similar arrangement for the odd pixels, SRAM 34 has its data output DO coupled to DFF 42.

Figure 4:
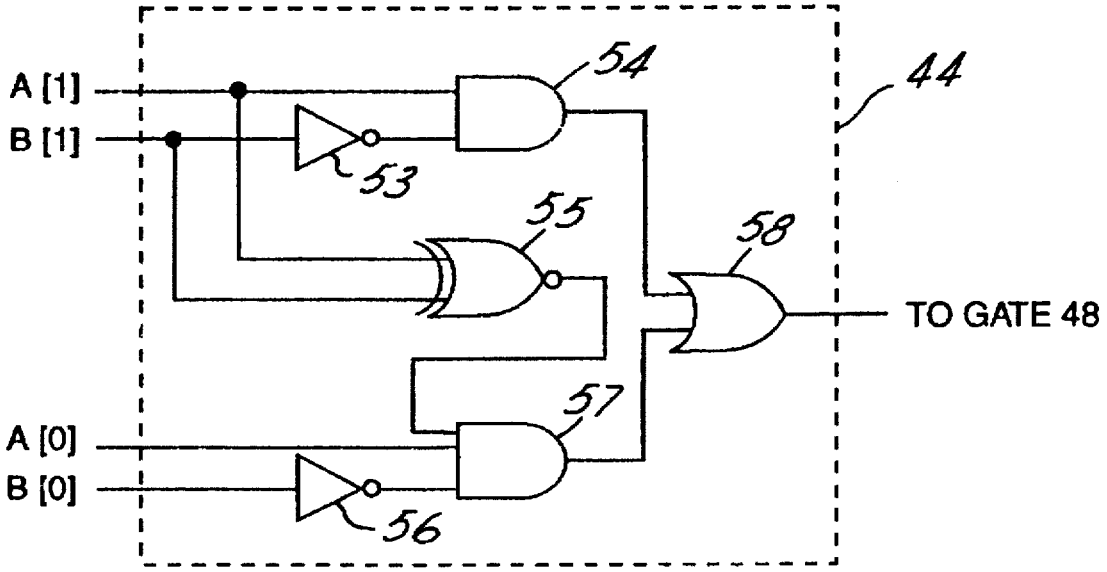
FIG. 4 is a schematic diagram view of a comparator employed in the preferred embodiment shown in FIG. 1, showing in greater detail the structure of the comparator.

Comparison means 43 is provided for determining, during the even state, whether the priority of the layer code portion of the input image data [LYI] is higher than the priority of the layer code portion of the image data stored in SRAM 32, and enabling, in response thereto, SRAM 32 to be written into with the input image data [CCI, LYI]. Comparison means 43 is further provided for determining, during the odd state, whether the priority of the layer code portion of the input image data [LYI] is higher than the priority of the layer code (i.e., [LYO]) portion of the image stored in SRAM 34, and enabling, in response thereto, SRAM 34 to be written into with the input image data [CCI, LYI]. Comparison means 43 preferably includes comparators 44 and 46, whose function is well known in the art. For example, FIG. 4 shows a preferred embodiment for comparator 44 including NOT gate 53, AND gate 54, exclusive NOR (XNOR) gate 55, NOT gate 56, AND gate 57, and OR gate 58. It should be understood that comparator 46 is preferably of identical construction. Comparator 44 is coupled to DFF 40, while comparator 46 is coupled to DFF 42. Comparator 44 includes two inputs A, B, and generates a logic one when input A >input B. Comparator 46 is identical to comparator 44.

Processing means 18 further includes NAND gate 48 for generating a control signal to control the R/$\overline{W}$ input of SRAM 32. Processing means 18 further includes NAND gate 50 for generating another control signal to control the R/$\overline{W}$ input of SRAM 34. NAND gates 48, 50 are both coupled to the even/odd select signal CNT [0], although NAND gate 48 is coupled by way of an inverted input. It should be appreciated that when the output of counter 36 CNT [M:0] is even, gate 50 will always control SRAM 34 for a read or retrieval operation, while when the output of counter 36 CNT [M:0] is odd, gate 48 will control SRAM 32 for a read or retrieval operation.

Processing means 18 includes NOR gate 52 for presetting the initial values for DFFs 40, 42. It should be appreciated that when the preset control signal PS is asserted, gate 52 will generate a signal which causes NAND gates 48 and 50 to place SEAMs 32, 34 in a read mode. Since counter 36 output CNT [M:0] is also being preset during assertion of the PS signal, both SEAMs 32, 34 are properly addressed through address means 16 to provide initial layer code values, which are latched into DFFs 40, 42 for subsequent processing.

Image register 10 is characterized by the fact that SEAMs 32 and 34 are provided for storing image data that is divided into two parts, one representing the odd number addresses and the other representing the even number addresses of the image register (i.e., the odd number pixels and the even number pixels). By dividing the storage of the image into multiple parts, parallel operation may be accomplished.

With continued reference to FIG. 1, the operation of image register 10 will now be described. The starting address n having a binary representation with bits [M:0] of the image data is first preset into counter 36 by assertion of the preset control signal PS and the presentation on the CPU bus of the input starting address [M:0]. Assertion of the preset control signal PS also functions to load DFF 40, 42 with initial values. Also assume at this time that the output enable signal OE is low, and that the enable EN is high. The output of counter 36 CNT [M:0] may be either an even number address or an odd number address. The LSB of counter 36 output, CNT [0], determines whether the output represents an even number address or odd number address (i.e., whether the register 10 is in an "even" state or "odd" state). When signal CNT [0] is "0", it indicates an even number address.

Assume n is even. In the even state, when the layer code portion of the input image data (LYI) has a priority higher than the priority of the layer code portion of SRAM 32 output (LYO), which may have been set either during the preset phase or during a prior processing cycle, comparator 44 outputs a logic "one" and gate 48 provides a low output to place SRAM 32 in a write mode. Simultaneously, gate 50 provides a high output to place SRAM 34 in a read mode to retrieve a layer code LYO therefrom. It should be appreciated that image register 10 is thus processing pixel data corresponding to a particular address n while retrieving pixel data corresponding to address n+1.

As counter 36 is incremented, a new processing cycle is begun wherein CNT [0]=1, an odd address and thus register 10 assumes the "odd" state. In the odd state, when the layer code portion of the input data (LYI) has a priority higher than a priority of the layer code portion of SRAM 34 output (LYO), comparator 46 outputs a logic one, and gate 50 generates a logic low signal to the R/$\overline{W}$ input to control SRAM 34 for a write operation; simultaneously, SRAM 32 is controlled for a read operation. It should be appreciated that when CNT [0] is "1", adder 38 advances so that the SRAM 32 outputs image data associated with the next even address of image register 10, which is equivalent to the next address of SRAM 32 (i.e., if the pixel data written into SRAM 34 corresponds to address n, then the pixel data retrieved from SRAM 32 corresponds to address n+1). The image data output of SRAM 32 is latched in DFF 40 and provided to comparator 44 for comparison during a next subsequent cycle. Table 1 depicts an exemplary range of addresses generated by counter 36, and the corresponding addresses generated for SRAMs 32, 34. The R/$\overline{W}$ inputs of SRAMs 32 and 34 are also provided in Table 1 below for purposes of illustration only.

TABLE 1

| Counter 36 Output [M:1] [0] | | | SRAM 32 Address | SRAM 34 Address | SRAM 32 R/$\overline{W}$ | SRAM 34 R/$\overline{W}$ |
|---|---|---|---|---|---|---|
| 0 | 0 | 0 | 00 | 00 | $\overline{A > B}$ | $\overline{A > B}$ |
| 0 | 0 | 1 | 01 | 00 | 1 | $\overline{A > B}$ |
| 0 | 1 | 0 | 01 | 01 | A > B | $\overline{A > B}$ |
| 0 | 1 | 1 | 10 | 01 | $\overline{A > B}$ | $\overline{A > B}$ |
| 1 | 0 | 0 | 10 | 10 | $\overline{A > B}$ | $\overline{A > B}$ |
| 1 | 0 | 1 | 11 | 10 | $\overline{A > B}$ | $\overline{A > B}$ |
| 1 | 1 | 0 | 11 | 11 | $\overline{A > B}$ | $\overline{A > B}$ |
| 1 | 1 | 1 | 100 | 11 | 1 | $\overline{A > B}$ |

FIG. 2 is a timing sequence chart for various input signals of image register 10. It should be appreciated that when the preset control signal PS is high, the starting address n, having bits [M:0], on the CPU bus is written into counter 36, which outputs starting address n. Further note that during a first period of input clock signal CLK, while image register 10 is processing image data for starting address n, the data D1 is selectively written into one of BRAMs 32, 34 (dependent on whether n is even or odd). During this first clock period, the image data associated with address n+1 is read and stored into one of DFFs 40, 42. During a next subsequent clock period, the image data associated with address n+1 stored in one of the SRAMs 32, 34 is compared (i.e., processed) with the input image data D2 [CCI, LYI] to determine whether it should be written in one of the SRAMs.

FIGS. 3A and FIG. 3B illustrate the advantages of the present invention as compared to prior art image registers. Referring now to FIG. 3A, a function sequence chart depicting the progress of image data processing in a prior art device is shown. A conventional prior art image register processes pixel data sequentially. Accordingly, in step 60 a prior art image register must read and latch the stored image data associated with starting address n (the so-called "wait" state). In step 62, the prior art image register then compares an input image data with the latched image data (for example, layer priority), and then selectively writes the input image data associated with address n if the comparison so dictates. Steps 64, 66 and 68 further show the two-step sequence required to process further pixels at consecutive addresses.

Referring now to FIG. 3B, the disclosed image register embodiment of the present invention operates on consecutive pixels in parallel to accelerate overall image processing. After an initial preset step 70, where counter 36 and buffers 40, 42 are initialized (i.e., filling the pipeline), respective read and write operations are performed during each clock period, in parallel, to thereby accelerate image data processing. For example, in step 72, the data associated with address n is compared and written into one of SPAMs 32, 34 (dependent on whether n is even or odd), in accordance with the priority associated with the layer code, while simultaneously in step 74, the reading and latching of the data associated with address n+1 is performed. The latched data from step 74 is then used in step 76. In parallel with step 76, the data associated with address n+2 is read and latched in step 78 for subsequent processing in step 80, and so on with steps 82, 84, 86, 88 and 90. It should appreciated from FIGS. 3A, and 3B that once the pipeline is filled in step 70, the parallel processing architecture of the present invention permits complete processing of a pixel every clock period. For example, in FIG. 3A, a prior art image register completely processes 2 pixels in the 5 clock periods shown. The image register 10 of the present invention, after a set-up clock cycle, completely processes 5 pixels in the next 5 clock periods, as shown in FIG. 3B.

Although the present invention has been described in an illustrative manner, it should be understood that the terminology used is intended to be in a nature of words of description, rather than of limitation.

Furthermore, while the present invention has been described in terms of a preferred embodiment thereof, it is to be appreciated that those skilled in the art will readily apply these teachings to other possible variations of the invention. For instance, other similar arrangements of the SRAMs, the adder and the comparator may be substituted for those shown and described in the preferred embodiment, while substantially accomplishing desirable results.

The embodiments of the invention in which an exclusive property or privilege is claimed are defined as follows:

What is claimed is:

1. An image register for processing image data associated with a range of addresses including even addresses and odd addresses wherein said image data includes a layer code portion, comprising:

a first memory means for storing image data associated with said even addresses;

a second memory means for storing image data associated with said odd addresses;

address means for addressing said first and second memory means in accordance with an even state and an odd state of said register; and processing means coupled to said first and second memory means for simultaneously, during said even state, reading stored image data from said second memory means and selectively writing input image data into said first memory means according to a priority associated with said layer code portion of said input image data, and for simultaneously, during said odd state, reading stored image data from said first memory means and selectively writing said input image data into said second memory means according to the priority associated with said layer code portion of said input image data, wherein said stored image data associated with even and odd addresses are operated on in parallel to thereby improve processing speed, wherein a priority of said even and odd addresses is determined in response to said image data stored in said first and second memory means without adding wait states.

2. The register of claim 1, wherein said processing means includes comparison means for determining, during said even state, whether the priority of said layer code portion of said input image data is higher than the priority of said layer code portion of said image data stored in said first memory means and enabling, in response thereto, said first memory means to be written into with said input image data, said comparison means being further provided for determining, during said odd state, whether the priority of said layer code portion of said input image data is higher than the priority of said layer code portion of said image data stored in said second memory means and enabling, in response thereto, said second memory means to be written into with said input image data.

3. The register of claim 1, wherein said first memory means and said second memory means each comprise a static random access memory (SRAM) device.

4. The register of claim 1, wherein said first and second memory means are each made of the group consisting of latch-type devices and D flip-flop (DFF)-type devices.

5. The register of claim 1, wherein said address means comprises a counter having a preset input for presorting said counter to a preselected initial value for addressing said second memory means, said address means further comprising an adder responsive to said counter output for addressing said first memory means.

6. The register of claim 5, wherein a least significant bit (LSB) of said counter is indicative of one of, said even and odd states.

7. An image register for processing image data associated with a range of addresses including even addresses and odd addresses wherein said image data includes a layer code portion, comprising:

a first memory for storing image data associated with said even addresses;

a second memory for storing image data associated with said odd addresses;

a counter having a preset input for presetting an output to a preselected value;

an adder responsive to said counter output for addressing said first memory;

a first buffer coupled to said first memory for temporarily storing said layer code portion of image data stored in said first memory;

a second buffer coupled to said second memory for temporarily storing said layer code portion of image data stored in said second memory;

a first comparator responsive to said first buffer and said layer code portion of input image data, said first comparator generating a first output signal when a priority of said layer code portion of said input image data is higher than the priority of said layer code portion of said stored image data from said first memory, said first output signal being coupled to said first memory for enabling a write operation; and, a second comparator responsive to said second buffer and said layer code portion of said input image data, said second comparator generating a second output signal when the priority of said layer code portion of said input image data is higher than the priority of said layer code portion of said stored image data from said second memory, said second output signal being coupled to said second memory for enabling a write operation.

8. An image register for processing image data associated with a range of addresses including even addresses and odd addresses wherein said image data includes a layer code portion, comprising:

a first memory means for storing image data associated with said even addresses;

a second memory means for storing image data associated with said odd addresses;

address means for addressing said first and second memory means in accordance with an even state and an odd state of said register; and, processing means coupled to said first and second memory means for simultaneously, during said even state, reading stored image data from said second memory means and selectively writing input image data into said first memory means according to a priority associated with said layer code portion of said input image data, and for simultaneously, during said odd state, reading stored image data from said first memory means and selectively writing said input image data into said second memory means according to the priority associated with said layer code portion of said input image data, wherein stored image data associated with even and odd addresses are operated on in parallel to thereby improve processing speed, wherein said processing means comprises first and second buffers respectively connected to said first and second memory means, said processing means further comprising first and second comparators each having a pair of inputs and an output, said layer code portion of said input image data being coupled to one input of each comparator, the other input of each comparator being connected to a respective output of said first and second buffers, said first and second comparator outputs being respectively coupled to said first and second memory means for controlling reading and writing operations.

9. The register of claim 8, wherein said first and second buffers each comprise a D-type flip-flop (DFF).

10. The register of claim 8, wherein said processing means further includes a pair of NAND gates respectively coupled to said first and second memory means and respectively responsive to said first and second comparator outputs for controlling said reading and writing operations.

* * * * *